US010323422B1

(12) United States Patent
Eddy

(10) Patent No.: US 10,323,422 B1
(45) Date of Patent: Jun. 18, 2019

(54) HAND RAILING SYSTEM

(71) Applicant: Victor Eddy, Parkersburg, WV (US)

(72) Inventor: Victor Eddy, Parkersburg, WV (US)

( * ) Notice: Subject to any disclaimer, the term of this patent is extended or adjusted under 35 U.S.C. 154(b) by 0 days.

(21) Appl. No.: 15/856,231

(22) Filed: Dec. 28, 2017

(51) Int. Cl.
*E04G 7/00* (2006.01)
*E04G 5/14* (2006.01)

(52) U.S. Cl.
CPC ..... *E04G 5/14* (2013.01); *E04G 7/00* (2013.01)

(58) Field of Classification Search
CPC ..... E04G 5/14; E04G 7/00
See application file for complete search history.

(56) References Cited

U.S. PATENT DOCUMENTS 346,019 A * 7/1886 Brick
2,159,902 A * 5/1939 Lewis ..... B63B 19/28 114/201 R
D142,496 S 10/1945 Reiner
3,752,262 A 8/1973 Helms
D272,766 S 2/1984 Guerrero
4,597,472 A 7/1986 Hjelm
5,145,030 A 9/1992 Pavlescak
5,314,167 A * 5/1994 Holloman ..... E04G 21/3223 182/113
6,450,291 B1 9/2002 Ono
9,388,540 B2 7/2016 Koering
2014/0252291 A1* 9/2014 Koering ..... E01D 19/103 256/64
2018/0127993 A1* 5/2018 Baca ..... E04G 21/3223

FOREIGN PATENT DOCUMENTS

DE 4412072 A1 * 10/1994 ..... E04G 5/14
GB 2056545 A * 3/1981 ..... E04G 5/14

* cited by examiner

*Primary Examiner* — Alvin C Chin-Shue

(57) ABSTRACT

A hand railing system for attaching a scaffolding hand rail to a scaffolding pick includes a platform that is removably coupled between a pair of scaffolds. Thus, the platform may support a user thereby facilitating the user to walk between the pair of scaffolds. A plurality of mounts is provided and each of the mounts removably engages the platform. Each of the mounts is oriented to extend upwardly from the platform. Additionally, each of the mounts receives a pole of a handrail thereby facilitating the handrail to extend along an entire length of the platform.

5 Claims, 5 Drawing Sheets

HAND RAILING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to rail devices and more particularly pertains to a new rail device for attaching a scaffolding hand rail to a scaffolding pick.

BRIEF SUMMARY OF THE INVENTION

An embodiment of the disclosure meets the needs presented above by generally comprising a platform that is removably coupled between a pair of scaffolds. Thus, the platform may support a user thereby facilitating the user to walk between the pair of scaffolds. A plurality of mounts is provided and each of the mounts removably engages the platform. Each of the mounts is oriented to extend upwardly from the platform. Additionally, each of the mounts receives a pole of a handrail thereby facilitating the handrail to extend along an entire length of the platform.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
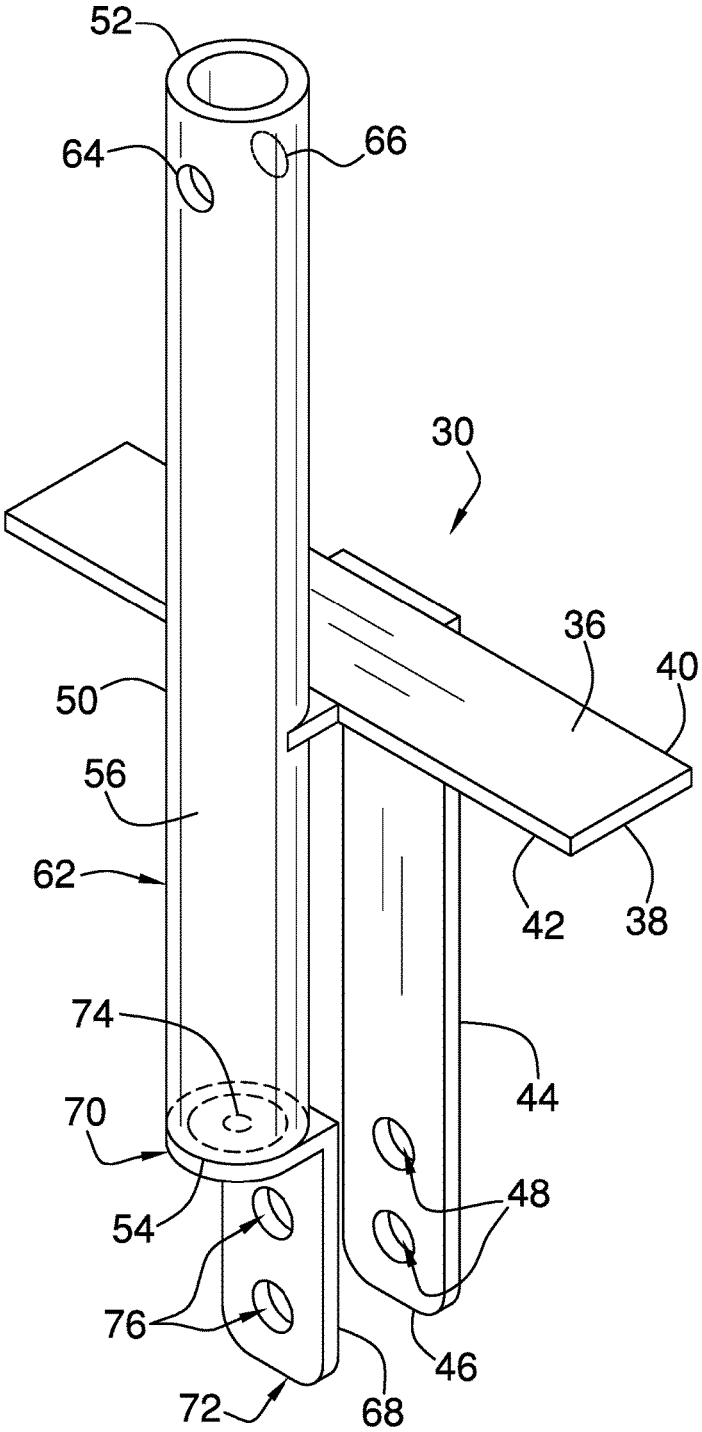
FIG. 1 is a perspective view of a mount of a hand railing system according to an embodiment of the disclosure.
Figure 2:
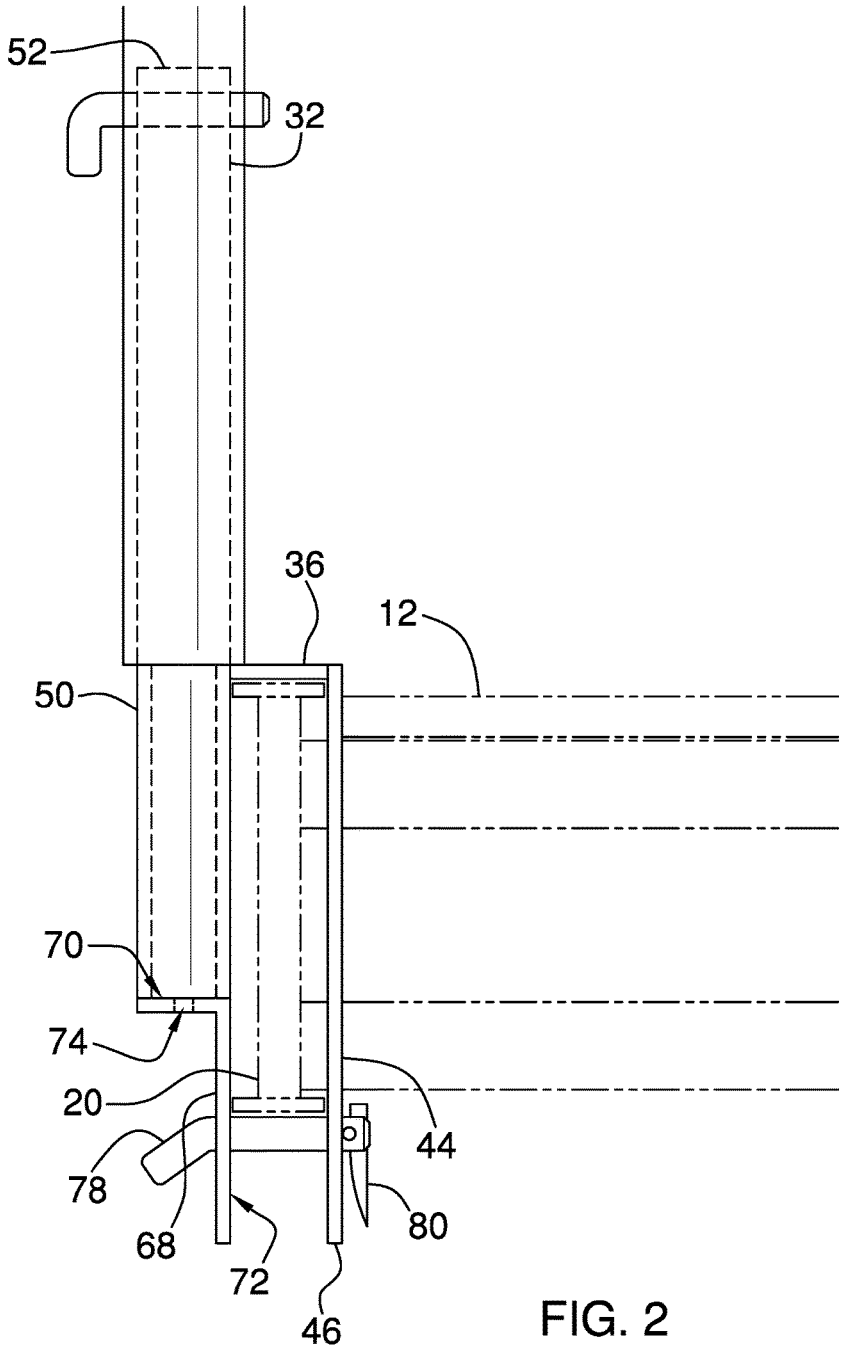
FIG. 2 is a phantom perspective view of an embodiment of the disclosure.
Figure 3:
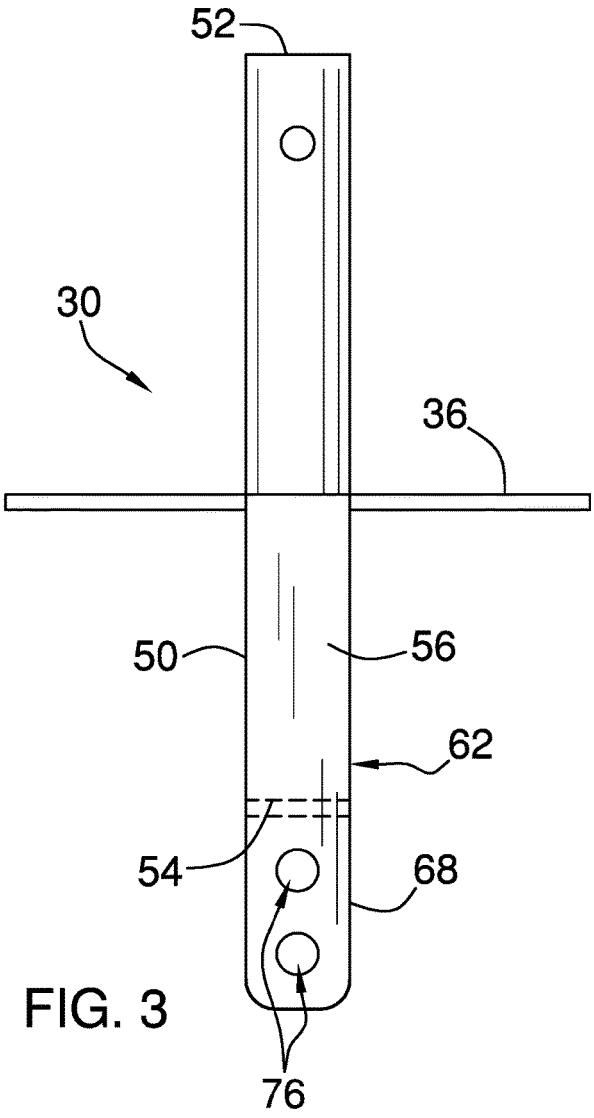
FIG. 3 is a front view of a mount of an embodiment of the disclosure.
Figure 4:
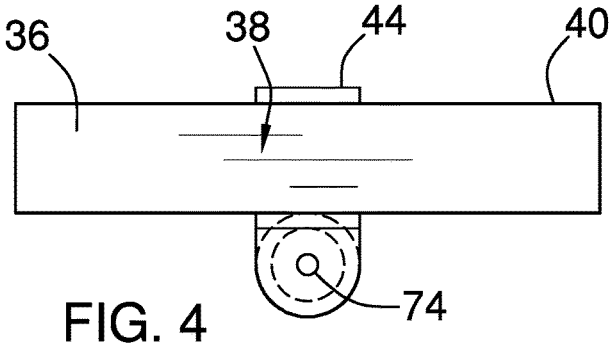
FIG. 4 is a bottom phantom view of a mount of an embodiment of the disclosure.
Figure 5:
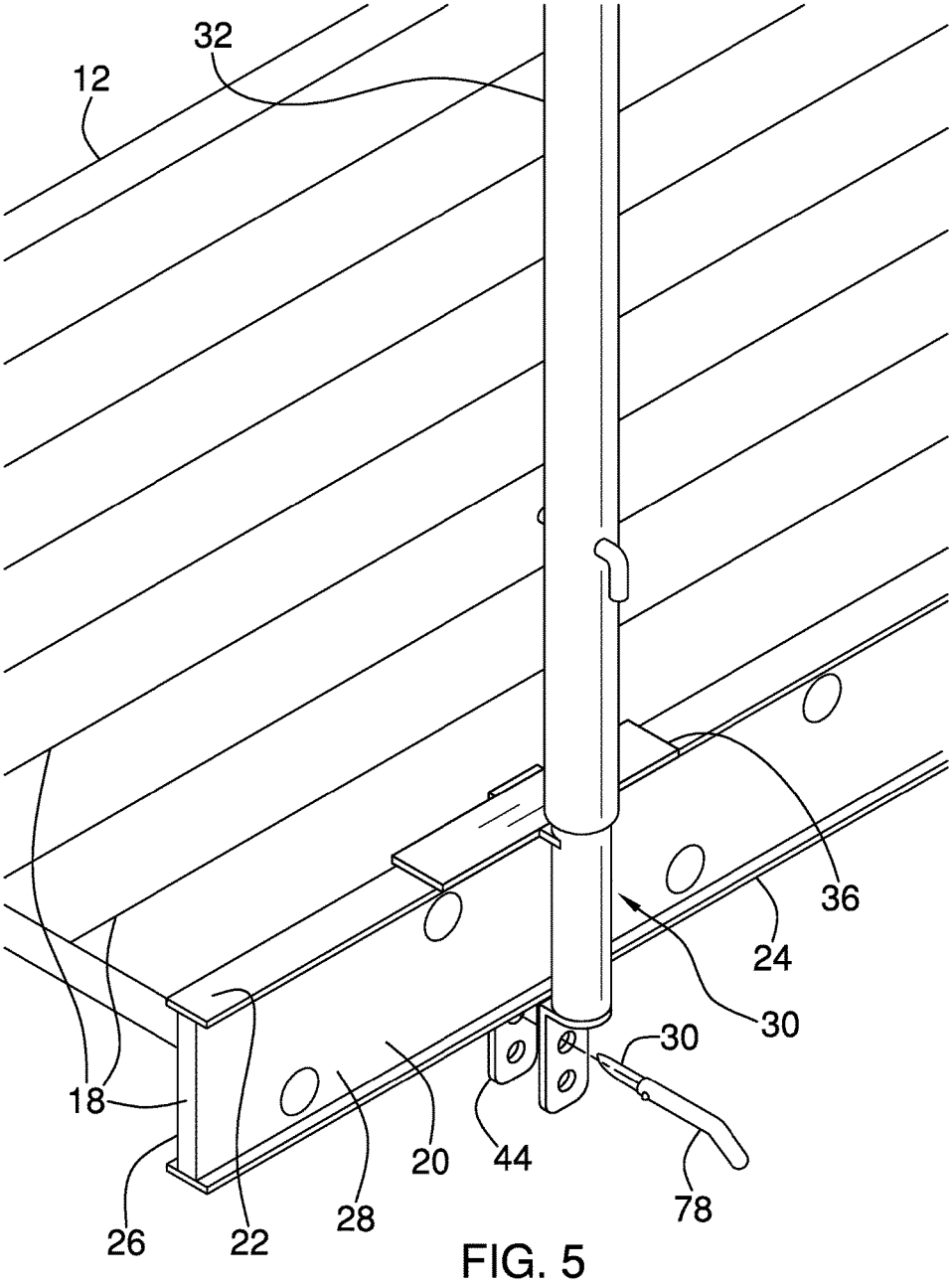
FIG. 5 is a perspective view of an embodiment of the disclosure.
Figure 6:
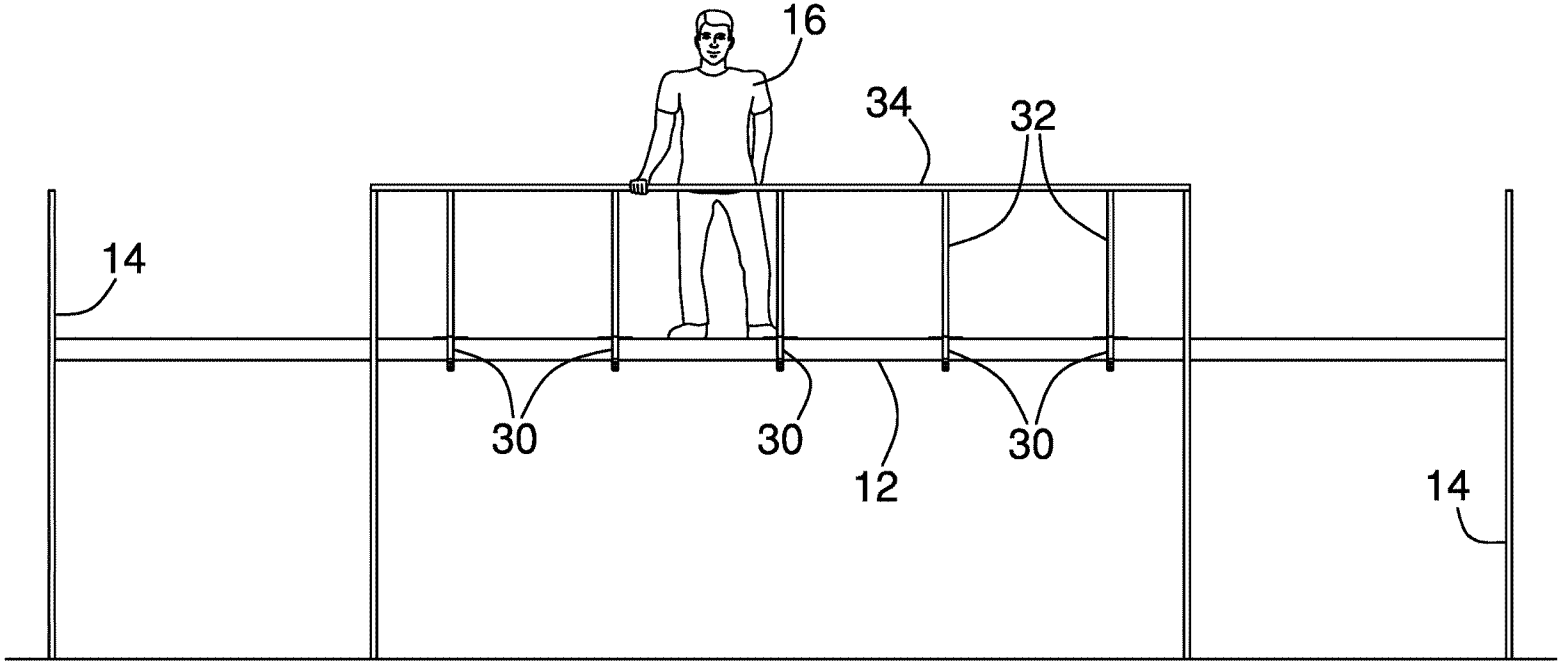
FIG. 6 is a perspective in-use view of an embodiment of the disclosure.

With reference now to the drawings, and in particular to FIGS. 1 through 6 thereof, a new rail device embodying the principles and concepts of an embodiment of the disclosure and generally designated by the reference numeral 10 will be described.

As best illustrated in FIGS. 1 through 6, the hand railing system 10 generally comprises a platform 12 that is removably coupled between a pair of scaffolds 14. The platform 12 supports a user 16 thereby facilitating the user 16 to walk between the pair of scaffolds 14. The platform 12 includes a plurality of members 18 and the members 18 of the platform 12 are spaced apart from each other. The plurality of members 18 includes an outermost member 20. The outermost member 20 has a top side 22, a bottom side 24, a first lateral side 26 and a second lateral side 28.

A plurality of mounts 30 is provided and each of the mounts 30 removably engages the platform 12. Each of the mounts 30 is oriented to extend upwardly from the platform 12. Additionally, a pole 32 of a handrail 34 is selectively attached to each of the mounts 30 thereby facilitating the handrail 34 to extend along an entire length of the platform 12. In this way the handrail 34 enhances safety for the user 16 when the user 16 is walking on the platform 12. The mounts 30 facilitate handrails for scaffolding to be attached to the platform 12 thereby eliminating the need for custom handrails to be constructed from lumber or other materials.

Each of the mounts 30 comprises a first member 36 that has a bottom surface 38, a first lateral edge 40 and a second lateral edge 42. The first member 36 is selectively positioned on the outermost member 20 having the bottom surface 38 abutting the top side 22 of the outermost member 20. Additionally, the first member 36 is oriented collinear with the outermost member 20. The first member 36 may have a length ranging between approximately 17.0 cm and 25.0 cm.

A second member 44 is coupled to and extends downwardly from the bottom surface 38 of the first member 36 and the second member 44 is aligned with the first lateral edge 40. The second member 44 extends downwardly along the first lateral side 26 of the outermost member 20 when the first member 36 is positioned on the outermost member 20. Additionally, the second member 44 may have a length ranging between approximately 17.0 cm and 25.0 cm. The second member 44 has a distal end 46 with respect to the first member 36 and the second member 44 has a pair of openings 48 extending therethrough. Each of the openings 48 is positioned closer to the distal end 46 than the first member 36. Thus, each of the openings 48 is positioned below the outermost member 20 when the first member 36 is positioned on the outermost member 20.

A tube 50 is provided that has a first end 52, a second end 54 and an outer wall 56 extending therebetween. The outer wall 56 of the tube is coupled to the second lateral edge 42 of the first member 36 and the tube 50 is oriented perpendicular to the first member 36. The tube 50 is aligned with and is oriented collinear with the second member 44. The first end 52 of the tube is spaced upwardly from the first member 36 and the second end 54 of the tube is spaced downwardly from the first member 36. The first end 52 of the tube 50 is extended into the pole 32 having the pole 32 abutting the first member 36. The outer wall 56 has a first aperture 64 extending into an interior of the tube 50 and the outer wall 56 has a second aperture 66 extending into the interior of the tube 50. The first aperture 64 is positioned on an opposite side of the tube 50 with respect to the second aperture 66. Moreover, the first aperture 64 is aligned with the second aperture 66 and each of the first aperture 64 and the second aperture 66 is positioned closer to the first end 52 than the second end 54.

A bracket 68 is provided that has a first section 70 being oriented perpendicular to a second section 72. The first section 70 is coupled to the second end 54 of the tube 50 and the second section 72 extends downwardly from the tube 50. A drain hole 74 extends through the first section 70 of the bracket 68 to facilitate rain and other liquid to drain from the tube 50. The second section 72 has a pair of openings 76 each extending through the second section 72. Each of the openings 76 in the second section 72 is aligned with a corresponding one of the openings 48 in the second member 44.

A pin 78 is selectively extended through selected ones of the openings 76,48 in the bracket 68 and the second member 44. The pin 78 extends across the bottom side 24 of the outermost member 20 of the platform 12. Thus, the pin 78 inhibits the corresponding mount 30 from being removed from the platform 12. The pin 78 may have a lock 80 that is pivotally coupled thereto and the lock 80 may be selectively positioned to be oriented collinear with the pin 78 and perpendicular to the pin 78. The lock 80 is oriented collinear with the pin 78 to facilitate the lock 80 and the pin 78 to be extended through the selected openings 76,48 in the bracket 68 and the second member 44. Additionally, the lock 80 is oriented perpendicular to the pin 78 when the pin 78 is extended through the bracket 68 and the second member 44 to inhibit the pin 78 from being removed.

In use, the platform 12 is positioned to extend between the pair of scaffolds 14 during construction work on a building or the like. In this way the user 16 may walk along the platform 12 to travel between the scaffolds 14. Each of the mounts 30 is positioned on the platform 12 and the mounts 30 are spaced apart from each other and are distributed along an entire length of the platform 12. Each of the poles 32 for the handrail 34 is positioned on the tube 50 corresponding to an associated one of the mounts 30. The handrail 34 is attached to each of the poles 32 thereby facilitating the handrail 34 to extend along the entire length of the platform 12. In this way existing scaffolding handrails may be employed on the platform 12 thereby eliminating the need to construct a custom handrail for the platform 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hand railing system, said system comprising:

a platform being removably coupled between a pair of scaffolds wherein said platform is configured to support a user thereby facilitating the user to walk between said pair of scaffolds, said platform including a plurality of members, said members being spaced apart from each other, said plurality of members including an outermost member, said outermost member having a top side, a bottom side, a first lateral side and a second lateral side; and a plurality of mounts, each of said mounts removably engaging said platform, each of said mounts being oriented to extend upwardly from said platform wherein each of said mounts is configured to have a pole of a handrail attached thereto thereby facilitating the handrail to extend along an entire length of said platform, each of said mounts comprising a first member having a bottom surface, a first lateral edge and a second lateral edge, said first member being selectively positioned on said outermost member having said bottom surface abutting said top side of said outermost member and having said first member being oriented having a longitudinal axis parallel with a longitudinal axis of said outermost member when said first member is positioned with said bottom surface abutting said top side of said outermost member, a second member being coupled to and extending downwardly from said bottom surface of said first member, said second member being aligned with said first lateral edge, said second member extending downwardly along said first lateral side of said outermost member when said first member is positioned on said outermost member, said second member having a distal end with respect to said first member, said second member having a pair of openings extending therethrough, each of said openings being positioned closer to said distal end than said first member such that each of said openings is positioned below said outermost member when said first member is positioned on said outermost member, a tube having a first end, a second end and an outer wall extending therebetween, and a bracket having a first section being oriented perpendicular to a second section, said first section being coupled to said second end of said tube having said second section extending downwardly from said tube, said second section having a pair of openings each extending through said second section, each of said openings in said second section being aligned with a corresponding one of said openings in said second member.

2. The assembly according to claim 1, wherein said tube is coupled to said second lateral edge of said first member having said tube being oriented perpendicular to said first member, said first end of said tube being spaced upwardly from said first member, said second end of said tube being spaced downwardly from said first member, said first end being configured to be extended into the pole having the pole abutting said first member.

3. The assembly according to claim 2, wherein said outer wall has a first aperture extending into an interior of said tube, said outer wall having a second aperture extending into said interior of said tube, said first aperture being positioned on an opposite side of said tube with respect to said second aperture, said first aperture being aligned with said second aperture, each of said first aperture and said second aperture being positioned closer to said first end of said tube than said second end of said tube.

4. The assembly according to claim 1, further comprising a pin being selectively extended through selected ones of said openings in said bracket and said second member of a corresponding one of said plurality of mounts, said pin extending across said bottom side of said outermost member of said platform such that said pin inhibits said corresponding one of said plurality of mounts from being removed from said platform.

5. A hand railing system being, said system comprising:

a platform being removably coupled between a pair of scaffolds wherein said platform is configured to support a user thereby facilitating the user to walk between said pair of scaffolds, said platform including a plurality of members, said members being spaced apart from each other, said plurality of members including an outermost member, said outermost member having a top side, a bottom side, a first lateral side and a second lateral side; and a plurality of mounts, each of said mounts removably engaging said platform, each of said mounts being oriented to extend upwardly from said platform wherein each of said mounts is configured to have a pole of a handrail attached thereto thereby facilitating the handrail to extend along an entire length of said platform, each of said mounts comprising:

a first member having a bottom surface, a first lateral edge and a second lateral edge, said first member being selectively positioned on said outermost member having said bottom surface abutting said top side of said outermost member and having said first member being oriented having a longitudinal axis parallel with a longitudinal axis of said outermost member when said first member is positioned with said bottom surface abutting said top side of said outermost member, a second member being coupled to and extending downwardly from said bottom surface of said first member, said second member being aligned with said first lateral edge, said second member extending downwardly along said first lateral side of said outermost member when said first member is positioned on said outermost member, said second member having a distal end with respect to said first member, said second member having a pair of openings extending therethrough, each of said openings being positioned closer to said distal end than said first member such that each of said openings is positioned below said outermost member when said first member is positioned on said outermost member, a tube having a first end, a second end and an outer wall extending therebetween, said tube being coupled to said second lateral edge of said first member having said tube being oriented perpendicular to said first member, said first end of said tube being spaced upwardly from said first member, said second end of said tube being spaced downwardly from said first member, said first end being configured to be extended into the pole having the pole abutting said first member, said outer wall having a first aperture extending into an interior of said tube, said outer wall having a second aperture extending into said interior of said tube, said first aperture being positioned on an opposite side of said tube with respect to said second aperture, said first aperture being aligned with said second aperture, each of said first aperture and said second aperture being positioned closer to said first end than said second end;

a bracket having a first section being oriented perpendicular to a second section, said first section being coupled to said second end of said tube having said second section extending downwardly from said tube, said second section having a pair of openings each extending through said second section, each of said openings in said second section being aligned with a corresponding one of said openings in said second member, and a pin being selectively extended through selected ones of said openings in said bracket and said second member of a corresponding one of said plurality of mounts, said pin extending across said bottom side of said outermost member of said platform such that said pin inhibits said corresponding one of said plurality of mounts from being removed from said platform.

* * * * *